United States Patent [19]

Robbins

[11] Patent Number: 4,836,554

[45] Date of Patent: Jun. 6, 1989

[54] GLOVE-AND-BALL SPORTS TOY

[75] Inventor: William D. Robbins, Succasunna, N.J.

[73] Assignee: Sports & Toys Concepts, Inc., Hackensack, N.J.

[21] Appl. No.: 192,303

[22] Filed: May 10, 1988

[51] Int. Cl.[4] ..... A63B 67/00

[52] U.S. Cl. ..... 273/321; 273/346; 273/414; 273/DIG. 30

[58] Field of Search ..... 273/321, 346, 412, 414, 273/26 E, DIG. 30

[56] References Cited

U.S. PATENT DOCUMENTS

| | | | |
|---|---|---|---|
| 3,153,537 | 10/1964 | Lewis | 273/412 |
| 3,731,927 | 5/1973 | Rocco, Jr. | 273/26 E |
| 3,941,383 | 3/1976 | Clarke | 273/346 |
| 3,953,030 | 4/1976 | Muchnick | 273/346 |
| 3,999,748 | 12/1976 | Clarke | 273/346 |
| 4,017,076 | 4/1977 | Bai | 273/346 |
| 4,029,316 | 6/1977 | Clarke | 273/346 X |
| 4,235,042 | 11/1980 | Hills | 273/414 X |
| 4,247,097 | 1/1981 | Schwartz | 273/DIG. 30 |
| 4,303,247 | 12/1981 | Fain | 273/324 |
| 4,718,677 | 1/1988 | Barnes | 273/346 X |

*Primary Examiner*—William H. Grieb

*Attorney, Agent, or Firm*—Klauber & Jackson

[57] ABSTRACT

A glove-and-ball sports toy comprising a glove in the form of a baseball glove and having a pocket, fingers, a thumb, webbing, and wrist strap, a ball formed from a soft, light material and simulating a baseball, and a flexible, elastic cord connecting said ball with said glove, the pocket having a patch of burr material attached to it, and the ball being covered with pile material effective to adhere to the burr material when the ball and the patch come into contact.

7 Claims, 1 Drawing Sheet

GLOVE-AND-BALL SPORTS TOY

FIELD OF THE INVENTION

This invention is concerned with a glove-and-ball sports toy, and is more particularly concerned with a baseball glove and tethered ball construction for use by small children.

BACKGROUND OF THE INVENTION

Gloves, especially baseball gloves, with tethered balls have been heretofore disclosed, for example, in Lewis U.S. Pat. No. 3,153,537 and in Rocco U.S. Pat. No. 3,731,927. These prior constructions are, however, primarily designed for persons of considerable skill and coordination and are difficult to use by very small children. Following the development of Velcro, various games involving balls or other projectiles were proposed, including some having baseball gloves and balls, which utilized VELCRO to make it possible for the ball or projectile to be caught, even by the relatively unskilled. Examples of U.S. patents disclosing such constructions are U.S. Pat. Nos. 3,941,383; 3,953,030; 3,999,748; 4,017,076; 4,029,316; 4,303,247; and 4,718,677. These proposals, however, are designed for play by two or more persons, e.g. two children playing "catch" or the like. A Velcro tethered ball construction is known in connection with a hand puppet, as seen in Hills, U.S. Pat. No. 4,235,042, but the construction of this device is neither adapted nor intended to develop and foster those skills which are needed in fielding a baseball.

OBJECTS OF THE INVENTION

It is, accordingly, an object of the invention to provide an improved glove-and-ball sports toy to be played by a single person.

It is another object of the invention to provide a sports toy of the character indicated, which is constructed to be played by persons of limited skill, and which aids in the development of eye-hand coordination.

It is a further object of the invention to provide a baseball glove and tethered ball construction which enables the player to improve his or her skill and coordination, and which fosters development of skills useful in fielding a baseball.

SUMMARY OF THE INVENTION

In accordance with the invention, there is provided a fielder's baseball glove and tethered ball construction for individual play by a child or person of limited skill and which fosters development of eye-hand coordination, which comprises a baseball glove formed from fabric or the like, and having a selected area of its "pocket" covered by a piece of burr type material, and a fabric covered ball, to which the burr material adheres, tethered to the webbing of the glove by means of an elastic cord.

BRIEF DESCRIPTION OF THE DRAWING

The foregoing objects and features of the invention will be more readily apparent from the following detailed description and from the drawing, wherein.

DESCRIPTION OF A PREFERRED EMBODIMENT

Figure 1:
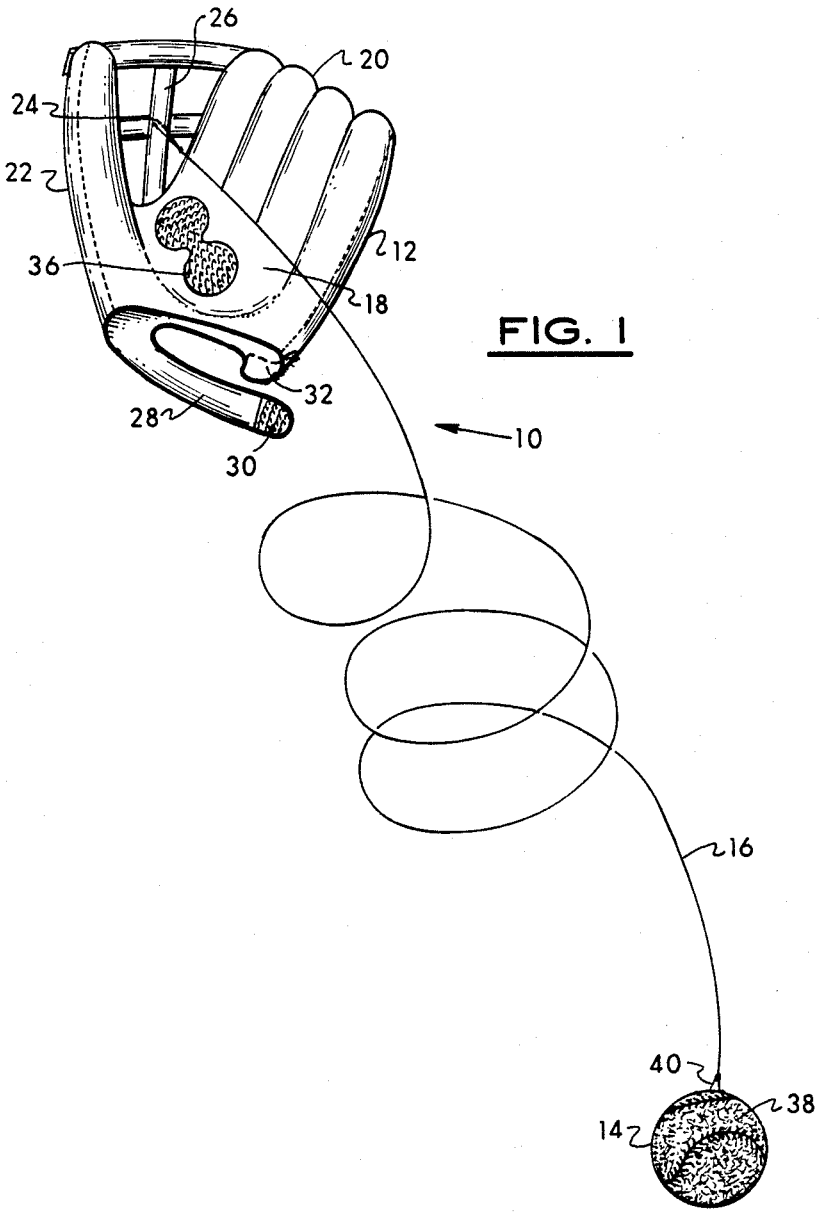
FIG. 1 is a perspective view of a baseball glove and tethered ball construction embodying features of the present invention.

Referring to the drawing, and especially to FIG. 1, the reference numeral 10 designates an illustrative embodiment of the glove-and-ball sports toy of the invention. Toy 10 includes a glove 12, in the form of a fielder's baseball glove, a ball 14, and an elastic tethering cord 16 connecting the ball to the glove. The glove 12 is formed from fabric of any desired type which is appropriately shaped to define a pocket 18 and fingers 20 and a thumb 22. The fingers are preferably interconnected near their ends by cords (not shown) which keep them in substantially abutting relationship, and the thumb and the first finger are joined by webbing 26. The glove 12 has a wrist strap 28 which is attachable to the glove body by a VELCRO connection. For this purpose, the end of the wrist strap is provided with a strip or patch of VELCRO hooks, i.e., burr material 30, and the cooperating part of the glove body is provided with a strip or patch having a face of pile, e.g., loop material 32, or the like, which is effectively engaged by the burr material when the two strips are brought together in overlying relationship.

Fasteners such as VELCRO, and constituting two surfaces of different cooperating natures, are described in U.S. Pat. Nos. 2,717,437; 3,009,235; 3,076,244; 3,083,737; 3,147,528; 3,154,837; and 4,058,853. The usual Velcro system includes two mating surfaces, one provided with a multiplicity of closely spaced plastic monofilamentary loops in the form of a pile and the other provided with a plurality of closely spaced monofilamentary plastic hooks. The flexible resilient hooks and the fabric containing the loops or pile are typically composed of a plastic such as nylon, polyvinyl chloride, polyvinyl acetate, polyethylene, polypropylene, especially isotactic polypropylene, and the like, although a metallic wire could be used, such as copper wire, steel wire, brass wire, aluminum wire, and the like.

Figure 2:
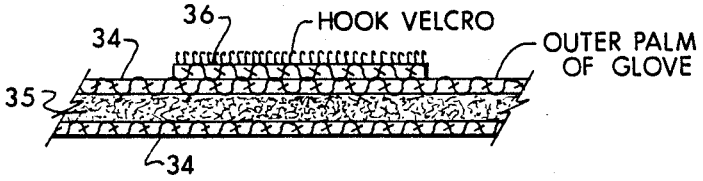
FIG. 2 is a fragmentary, greatly enlarged, cross-sectional view of the glove construction of FIG. 1 through the palm of the glove of FIG. 1.

As seen in FIG. 2, the outwardly facing layers 34 defining the body of the glove 12 are suitably formed of any suitable relatively-soft fabric or flocked cloth or like material, such as tricot nylon. Layers 34 sandwich a padding layer 35 of fabric or of synthetic sponge plastic or rubber or the like. Layer 35 serves suitably as padding for the padded portions of the glove, especially in the finger and thumb areas. Other materials may also be used for the padding The webbing 26 is suitably formed from fabric, such as the fabric of layers 34, which is coated or backed with sponge of rubber or plastic which is retroverted upon itself and sewn at its ends to the glove body.

In accordance with the invention, the pocket 18 is provided with a patch 36 of Velcro hook material which is stitched to the glove body. The patch 36 is of a bright color contrasting with the color of the body of glove 12 in order to enable accurate positioning of the ball in the glove, and the patch 36 is suitably given a shape, two hinged circular flaps or a solid FIG. 8, as shown in FIG. 1, which permits the pocket 18 to be pliable and flexible as a conventional fielder's glove, by reason of the fact that the patch 36 can readily bend at its narrow center. Cooperating with the glove 12 is a ball 14. The ball 14 is soft, e.g. formed from "new material", polyester or the like (not shown), covered with material 38 having a face or pile, e.g., a loop material, or the like, e.g., nylon tricot plush, which cooperates with the hooks of patch 36 to hold the ball when the two engage, but not to engage with the fabric o the remainder of the body of the glove. The cover 38 is cut and designed to simulate a baseball The ball 14 is formed with an external loop 40, and a flexible elastic cord 16 connects loop 40, and therefore ball 14, to glove 12. For this purpose, the other end of cord 16 is connected to the webbing 26 of glove 12, e.g. by being passed through apertures 42 and tied.

When the glove-and-ball sports toy of the invention is used, the user slips the glove 12 on his catching hand, closes the wrist strap by engaging hook or burr strip 30 with pile strip 32 and throws the ball 14 with his or her other hand. The ball 14 will travel outwardly until the elastic action of cord 16 stops its flight and draws it back toward the glove 12. When the ball 14 strikes the pocket 18, it will be caught, by reason of the interaction of the VELCRO hook patch 36 and the pile material covering ball 16, regardless of the position of the ball. On the other hand, if the ball 16 on its return flight does not strike VELCRO hook patch 36, it will not adhere to the glove 12 but, of course, may be caught if the user closes his or her fingers and thumb. The child or other user who may initially have limited skills is therefore not frustrated by being unable to catch the ball; but rather is encouraged to develop his or her skills, by so positioning the glove that the ball strikes the VELCRO hook patch 36 and adheres to the glove, and by otherwise manipulating his or her fingers and thumb to catch the ball in other parts of the glove. Since the techniques used indeed correspond to the manner in which a conventional fielding glove is used, the child quickly and naturally acquires proper fielding skills. Indeed, the present device is extremely beneficial in developing hand-eye coordination. In the use of this ball-and-glove device, the user does not need a companion and can practice throwing and catching solely by himself or herself. The glove is comfortable by reason of its soft covering and by reason of its fabric, rubber or plastic sponge content. The entire device is machine washable and dryer-safe. The ball is lightweight and can be easily thrown, even by a small child, and it is soft so that the child will not be injured should he or she be inadvertently struck by it, and it cannot bruise the hand when it is caught. The toy of the invention is of an economical construction, is made of readily-available materials, and is capable of providing the user hours of enjoyment.

It will, of course, be obvious that various changes and modifications may be made without departing from the invention as defined in the appended claims and it is intended, therefore, that all matter contained in the foregoing description and in the drawing shall be interpreted as illustrative only and not as limitative of the invention.

I claim:

1. A glove-and-ball sports toy comprising, in combination, (1) a glove having a pocket, fingers, and a thumb, (2) a ball formed from a soft, lightweight material, and (3) a flexible, elastic cord connecting said ball with said glove, said glove having a patch of burr material attached thereto solely in the area of said pocket and said ball being covered with pile material effective to adhere to said burr material when said ball and said patch come into contact.

2. A glove-and-ball sports toy comprising, in combination, (1) a glove in the form of a baseball glove and having a pocket, fingers, a thumb, webbing, and a wrist strap, (2) a ball formed from a soft, light material and simulating a baseball, and (3) a flexible, elastic cord connecting said ball with said glove, said glove having a patch of burr material attached thereto solely in the area of said pocket and said ball being covered with pile material effective to adhere to said burr material when said ball and said patch come into contact.

3. A sports toy as defined in claim 2, wherein said wrist strap is provided at its end with burr material and there is provided on said glove a cooperating area of pile material effective to close said strap around the wrist of the user when said end of said strap and said area are brought into contact.

4. A sports toy as defined in claim 1, wherein said glove is formed from an outer fabric which covers a padding of soft fabric or sponge plastic or rubber.

5. A sports toy as defined in claim 1, wherein said ball is light and soft.

6. A sports toy as defined in claim 5, wherein the cover of said ball contains markings simulating the stitching of a baseball.

7. A sports toy as defined in claim 2, wherein said cord tethering said ball to said glove is secured to the said webbing of said glove.

* * * * *